US006265700B1

(12) United States Patent
Miyata et al.

(10) Patent No.: US 6,265,700 B1
(45) Date of Patent: Jul. 24, 2001

(54) CERAMIC HEATER

(75) Inventors: Fumishige Miyata; Tatsuya Koyama; Seiko Okuda, all of Gifu (JP)

(73) Assignee: Ibiden Co., Ltd., Gifu (JP)

( * ) Notice: Subject to any disclaimer, the term of this patent is extended or adjusted under 35 U.S.C. 154(b) by 0 days.

(21) Appl. No.: 09/534,542

(22) Filed: Mar. 27, 2000

(30) Foreign Application Priority Data

Mar. 26, 1999 (JP) ..... 11-084077

(51) Int. Cl.[7] ..... H05B 3/44
(52) U.S. Cl. ..... 219/544; 219/542; 219/548
(58) Field of Search ..... 219/270, 505, 219/552, 553, 554, 544, 548, 543, 542; 338/226; 29/611; 501/97.1, 97.2, 97.3, 97.4

(56) References Cited

U.S. PATENT DOCUMENTS 4,035,613 * 7/1977 Sagawa et al. ..... 219/552
4,540,479 * 9/1985 Sakurai et al. ..... 219/544
4,733,056 * 3/1988 Kojima et al. ..... 219/543
5,451,748 * 9/1995 Matsuzaki et al. ..... 219/543
5,948,306 * 9/1999 Konishi et al. ..... 219/548
6,049,065 * 4/2000 Konishi ..... 219/270
6,084,220 * 7/2000 Suematsu et al. ..... 219/544

* cited by examiner

*Primary Examiner*—Tu Ba Hoang
(74) *Attorney, Agent, or Firm*—Sughrue, Mion, Zinn, Macpeak & Seas, PLLC

(57) ABSTRACT

This invention has as its object to provide a ceramic heater provided at low cost without being compromised in its performance, with the result that a ceramic heater equivalent to the conventional product in performance characteristics can be manufactured at reduced cost. A ceramic heater comprising a core, an insulation sheet covering the core and a resistance heating element of high-melting metal embedded between the core and insulation sheet, a high-temperature part of the resistance heating element, the operating temperature of which reaches 300° C. or higher, comprises a high-melting metal supplemented with Re or Mo.

2 Claims, 3 Drawing Sheets

CERAMIC HEATER

FIELD OF THE INVENTION

The present invention relates to a ceramic heater comprising a resistance heating element embedded in ceramics.

BACKGROUND OF THE INVENTION

The ceramic heater comprising a resistance heating element of high-melting metal as embedded between a core and an insulation sheet covering the core is in widespread use as a heating means for the automotive oxygen sensor, glow system, etc. or as a heat source for devices for gassification of petroleum oil, such as a heater for use in semiconductor heating or an oil fan heater.

FIG. 3(*a*) is a perspective view showing a ceramic heater of this type schematically and (b) is a sectional view taken along the line A—A of (a).

This ceramic heater comprises a cylindrical core 10, an insulation sheet 12 wrapped around said core 10 with an adhesive layer 11 interposed, and a resistance heating element 13 embedded between said core and insulation sheet, with terminal portions of said resistance heating element 13 being connected to external terminals 14 disposed externally of said insulation sheet 12 and lead wires 16 being connected to said external terminals 14, respectively.

As illustrated in FIG. 3(*b*), each terminal portion of said resistance heating element 13 is connected to the corresponding external terminal 14 via a plated-through hole 15 provided under the external terminal 14 in the insulation sheet 12. In this arrangement, as an electric current is applied between said external terminals 14 through said lead wires 16, the resistance heating element 13 generates heat and thereby functions as a heater.

When this heater is operated under a high temperature setting as in the above application, the resistance heating element must be caused to generate a high-temperature heat and, therefore, it is common practice to use a high-melting metal such as tungsten (W) as the material of the resistance heating element. However, there is the problem that, when used at a high temperature, a metal of this kind reacts with the surrounding ceramics to form the silicide and oxide and affect the resistance value of the heating element. Generally a ceramic heater is operated at a constant voltage and, therefore, as the resistance value of the resistance heating element is altered in this manner, the heater temperature is also affected. Such a change in heater temperature should be avoided as far as possible. Moreover, as the oxidation progresses further, the heater is degraded to suffer a problem in durability.

Therefore, it is common practice to supplement a high-melting metal with rhenium (Re) and use the alloy for the high resistance heating element to thereby control the change in resistance. Thus, Re is added to the high-melting metal such as W to reduce its reactivity with the surrounding ceramics at a high temperature and thereby control the change in resistance.

However, Re is a very expensive element and, for this reason, is a factor in the high production cost of a ceramic heater.

Moreover, in order to avoid degradation of the resistance heating element (conductor), the connecting terminals and resistance heating element proper to be formed inside of the insulation sheet are conventionally composed of an Re-containing conductor (resistance heating material) but this practice leads to a further increase in the production cost of a ceramic heater.

SUMMARY OF THE INVENTION

In view of the above state of the art, the inventors of the present invention scrutinized the mechanism of reaction between the metal constituting the resistance heating element and ceramics in a ceramic heater and found that while the high-melting metal such as W in the high-temperature part of the resistance heating element which reaches 300° C. or higher reacts with the surrounding ceramics to form the silicide and oxide, this reaction does not substantially take place in the low-temperature part of the heating element and that, therefore, by using an Re-containing high-melting metal selectively for only the high-temperature part of the heating element which reaches 300° C. or higher, the change in resistance of the resistance heating element and the heater degradation due to aging can both be sufficiently precluded and, in addition, the ceramic heater can be fabricated at a low cost as compared with the prior art. The present invention has accordingly been developed.

The present invention, therefore, is directed to a ceramic heater comprising a core, an insulation sheet covering said core, and a resistance heating element of high-melting metal as embedded between said core and insulation sheet, a high-temperature part of said resistance heating element, the operating temperature of which reaches 300° C. or higher, comprises a high-melting metal supplemented with Re or Mo.

DETAILED DESCRIPTION OF THE INVENTION

Figure 1:
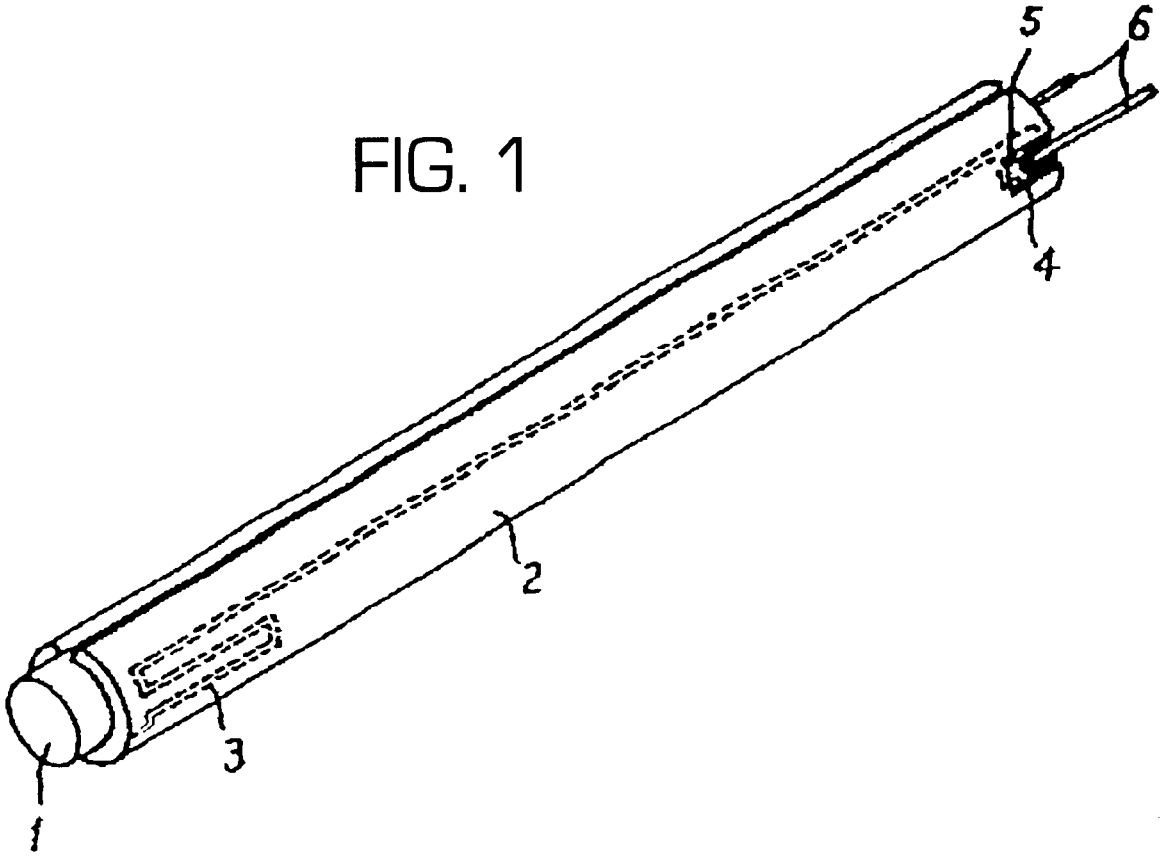
FIG. 1 is a perspective view showing the construction of the ceramic heater according to the present invention.

FIG. 1 is a schematic perspective view showing a ceramic heater according to the present invention.

As illustrated in FIG. 1, the ceramic heater of the invention comprises a cylindrical core 1, an insulation sheet 2 covering said core 1 leaving its leading end exposed, and a resistance heating element 3 embedded between said core and insulation sheet, with terminals 4 connected to the end of said resistance heating element 3 being exposed through cutouts 5 in said insulation sheet 2 and lead wires 6 being soldered to said exposed terminals 4 interposed with solder. The core 1 and insulation sheet 2 comprises a ceramic material such as alumina, aluminum nitride, mullite, cordierite or the like.

Figure 2:
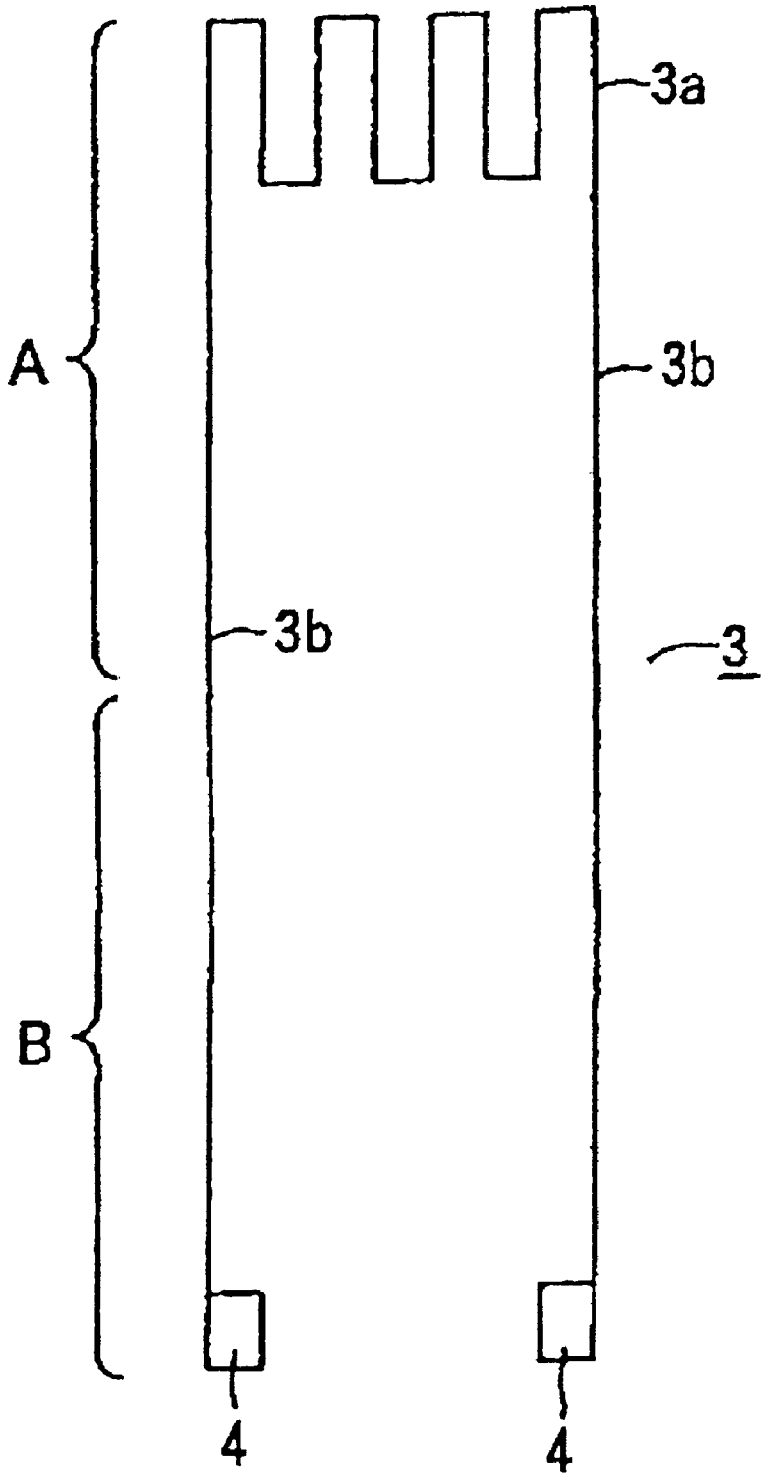
FIG. 2 is a developed view of the resistance heating element and other members constituting the ceramic heater of the present invention.
Figure 3A:
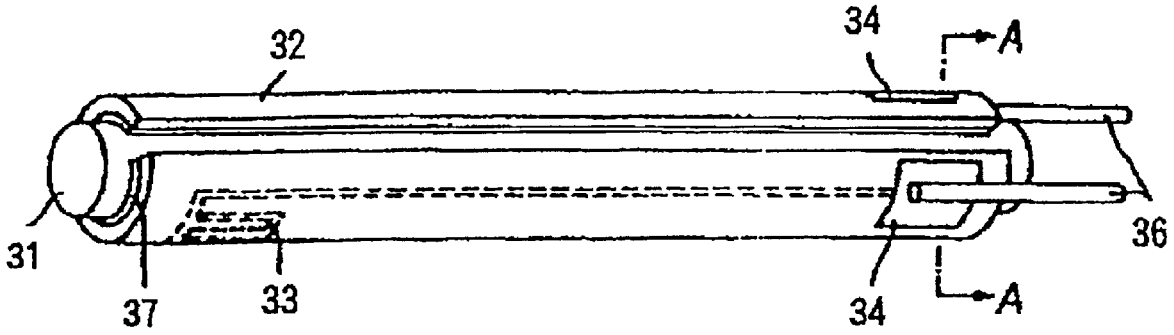
FIG. 3(a) PRIOR ART
FIG. 3(*a*) is a perspective view showing the construction of the conventional ceramic heater and (b) is a sectional view taken along the line A—A of (a).
Figure 3B:
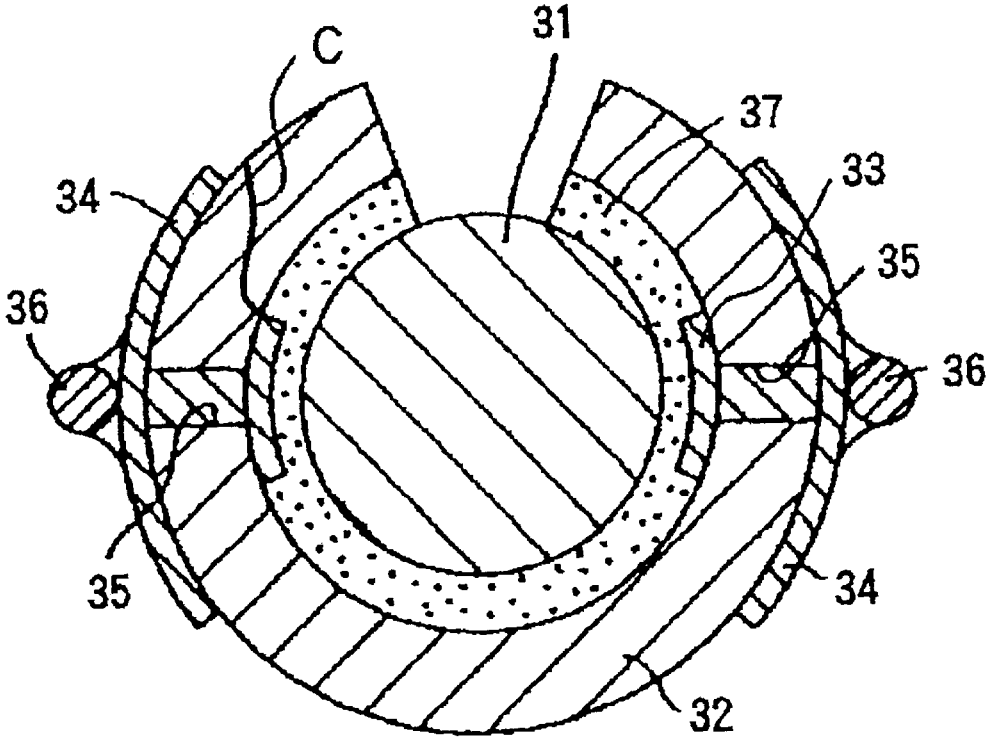
FIG. 3(b) PRIOR ART

FIG. 2 is a developed view showing the resistance heating element 3 disposed around the core 1. As illustrated in FIG. 2, this resistance heating element 3 comprises a heat-generating part 3*a* and a conductor part 3*b*. The conductor part 3*b* extends axially to connect the comb-shaped heat-generating part 3*a* disposed adjacent to said one axial end of the core 1 to the terminals 4 disposed adjacent to said other end of the core 1. On applying the current, chiefly the heat-generating part 3*a* generates heat to play the role of a heater.

Moreover, in this resistance heating element 3, the high-temperature part indicated at A in FIG. 2 is composed of a high-melting metal supplemented with Re or Mo, while the low-temperature part indicated at B is composed exclusively of a high-melting metal. The terminals 4 are also composed of a high-melting metal.

The high-melting metal mentioned above includes but is not limited to tungsten (W), tantalum (Ta), niobium (Nb) and titanium (Ti). These metals may be used each alone or in a combination of two or more species. Among the metals mentioned above, W is preferred.

The high-temperature part A is the part which reaches 300° C. or higher on the heating mode of the resistance heating element 3. Therefore, this part of the resistance heating element 3 preferably comprises a high-melting metal containing 3 to 20 weight % of Re and 70 to 95 weight % of W or a high-melting metal containing 3 to 20 weight % of Mo and 70 to 95 weight % of W. More preferably, it comprises a high-melting metal containing 10 to 18 weight % of Re and 75 to 90 weight % of W or a high-temperature metal containing 5 to 15 weight % of Mo and 75 to 90 weight % of W.

As the component other than the above-mentioned components, a ceramic component such as $Al_2O_3$ can be mentioned.

The reason for use of a high-melting metal supplemented with Re or Mo in the part of resistance heating element 3 which reaches 300° C. or higher on the heating mode of the ceramic heater is that the reaction between the simple high-melting metal and the ceramics starts at a temperature of not less than 300° C.

The temperature setting and the temperature profile of the ceramic heater are dependent on the temperature required of the heater and the composition of the high-melting metal used. Therefore, the relative dimensions of high-temperature part A and low-temperature part B shown in FIG. 2 are a mere example and the breadths of A and B should vary according to the temperature to be developed on the heating mode of the resistance heating element 3 and the composition of the high-melting metal used.

The method of fabricating the ceramic heater is not particularly restricted but usually the ceramic heater is fabricated in the following manner. A ceramic green sheet preformed with a conductor paste layer corresponding to the resistance heating element 3 and connecting terminals 4 shown in FIG. 2 is wrapped around a core with the conductive paste layer inside and the assembly is sintered to construct the main part of the ceramic heater. Then, lead wires are rigidly connected and soldered to the cutouts by using solder.

The above-mentioned green sheet formed with a conductive paste layer can be prepared by, for example, printing the surface of a plastic film (release film) with an adhesive layer, a conductive paste layer and a green sheet layer serially in superimposition, drying the print, and peeling off the laminate comprising said conductive paste layer and green sheet from the plastic film.

In the conductive paste printing process of the present invention, a conductive paste containing Re or Mo and high-melting metal is used to form a conductive paste layer corresponding to high-temperature part A by, for example, the screen printing technique and, then, a conductive paste containing a Re/Mo-free high-melting metal is used to form a conductor paste layer corresponding to the low-temperature part B and terminals 4 by the same technique. The order of printing may be reversed. However, the high-temperature part A must be connected, in the part where the operating temperature will not exceed 300° C., to the low-temperature part. Therefore, the conductive paste containing Re or Mo and high-melting metal may ingress somewhat into the low-temperature part B but the reverse is undesirable.

The conductive paste containing Re or Mo and high-melting metal can be prepared by using a Re or Mo powder and a high-melting metal powder or by using a Re or Mo-high-melting metal alloy powder.

In accordance with the present invention wherein an expensive Re- or Mo-containing high-melting metal is used for the high-temperature part which reaches 300° C. or higher on the heating mode of the resistance heating element and an Re- and Mo-free high-melting metal is used for the remaining part, the resistance heating element can be provided at low cost without being compromised in its performance, with the result that a ceramic heater equivalent to the conventional product in performance characteristics can be manufactured at reduced cost.

What is claimed is:

1. A ceramic heater comprising a core, an insulation sheet covering said core and a resistance heating element of high-melting metal embedded between said core and insulation sheet, wherein a high-temperature part of said resistance heating element, the operating temperature of which reaches 300° C. or higher, comprises a high-melting metal containing 3 to 20 weight % of Re, 70 to 95 weight % of W and the remainder of a ceramic component.

2. A ceramic heater comprising a core, an insulation sheet covering said core and a resistance heating element of high-melting metal embedded between said core and insulation sheet, wherein a high-temperature part of said resistance heating element, the operating temperature of which reaches 300° C. or higher, comprises a high-melting metal containing 3 to 20 weight % of Mo, 70 to 95 weight % of W and the remainder of a ceramic component.

* * * * *